US010208576B2

(12) United States Patent
Heizinger et al.

(10) Patent No.: US 10,208,576 B2
(45) Date of Patent: Feb. 19, 2019

(54) PUMP SYSTEM FOR DELIVERING VISCOUS OR PARTIALLY VISCOUS MEDIA FROM A BOREHOLE

(71) Applicant: NETZSCH Pumpen & Systeme GmbH, Selb (DE)

(72) Inventors: Klaus Heizinger, Pomerode (BR); Lorenz Lessmann, Pomerode (BR); Eudes Borchardt, Pomerode (BR); Leoncio Del Pozo, Rada Tilly (AR)

(73) Assignee: NETZSCH Pumpen & Systeme GmbH, Selb (DE)

( * ) Notice: Subject to any disclaimer, the term of this patent is extended or adjusted under 35 U.S.C. 154(b) by 148 days.

(21) Appl. No.: 15/239,469

(22) Filed: Aug. 17, 2016

(65) Prior Publication Data

US 2016/0356135 A1 Dec. 8, 2016

Related U.S. Application Data

(63) Continuation of application No. PCT/DE2015/000069, filed on Feb. 13, 2015.

(30) Foreign Application Priority Data

Feb. 19, 2014 (DE) ..... 10 2014 102 126

(51) Int. Cl.
*E21B 43/12* (2006.01)
*F04C 13/00* (2006.01)
(Continued)

(52) U.S. Cl.
CPC ..... *E21B 43/128* (2013.01); *E21B 17/1078* (2013.01); *E21B 43/121* (2013.01);
(Continued)

(58) Field of Classification Search
CPC .... E21B 43/128; E21B 43/121; E21B 43/126; E21B 23/02; E21B 17/1078;
(Continued)

(56) References Cited

U.S. PATENT DOCUMENTS 5,108,273 A * 4/1992 Romanyszyn, Jr. .. F04C 2/1073 137/99
5,343,942 A * 9/1994 Del Serra ..... E21B 17/1035 166/241.7
(Continued)

FOREIGN PATENT DOCUMENTS

DE 102010037440 A1 3/2012
DE 102011077777 B3 7/2012

OTHER PUBLICATIONS

International Search Report (translation) Application No. PCT/DE2015/000069 Completed May 28, 2015; dated Jun. 10, 2015 2 pages.
(Continued)

*Primary Examiner* — George S Gray
(74) *Attorney, Agent, or Firm* — Whitmyer IP Group LLC

(57) ABSTRACT

A pump system and a method for pumping viscous or partially viscous media out of a borehole. The pump system includes a well pipe which is installed in the borehole and a motor which is coupled to an eccentric screw pump, the eccentric screw pump including one or more stators and one or more rotors which are received in the stator(s) so as to rotate eccentrically. One or more connection mechanisms fix the eccentric screw pump in the well pipe in a force-fitting and/or formfitting manner. For the purpose of removing the eccentric screw pump from the borehole, the eccentric screw pump is held by means of the one or more connection mechanisms with an axial freedom of movement.

21 Claims, 8 Drawing Sheets

(51) Int. Cl.

| | |
|---|---|
| ***F04C 2/107*** | (2006.01) |
| ***E21B 17/10*** | (2006.01) |
| ***F04C 2/16*** | (2006.01) |
| ***F04C 15/00*** | (2006.01) |

(52) U.S. Cl.
CPC ..... *F04C 2/1073* (2013.01); *F04C 2/16* (2013.01); *F04C 13/008* (2013.01); *F04C 15/008* (2013.01); *F04C 2240/40* (2013.01)

(58) Field of Classification Search
CPC ..... F04C 13/008; F04C 15/008; F04C 2/16; F04C 2/107–2/1078; F04C 2240/40
See application file for complete search history.

(56) References Cited

U.S. PATENT DOCUMENTS

| | | | | |
|---|---|---|---|---|
| 5,746,582 | A * | 5/1998 | Patterson | E21B 23/02 166/377 |
| 6,322,331 | B1 * | 11/2001 | Swatek | E21B 17/18 166/105 |
| 6,595,295 | B1 | 7/2003 | Berry et al. | |
| 2007/0074871 | A1 | 4/2007 | Olson et al. | |
| 2009/0266561 | A1 * | 10/2009 | Cobb | E21B 43/128 166/385 |
| 2010/0316518 | A1 * | 12/2010 | Guidry, Jr. | E21B 4/02 418/48 |

OTHER PUBLICATIONS

Written Opinion of the International Searching Authority Application No. PCT/DE20105/000069 dated Jun. 10, 2015 5 pages.

* cited by examiner

PUMP SYSTEM FOR DELIVERING VISCOUS OR PARTIALLY VISCOUS MEDIA FROM A BOREHOLE

TECHNICAL FIELD

The present invention relates to a pump system for delivering viscous or partially viscous media from a borehole. In addition, the present invention relates to a method for removing an eccentric screw pump from a borehole.

BACKGROUND

Eccentric screw pumps known from the prior art are constituted by a rotor and a stator, wherein the rotor is accommodated in the stator and moves eccentrically in the stator. Moving delivery spaces are formed between the stator and the rotor as a result of the motion of the rotor and the mutual contact, by means of which delivery spaces liquid and/or grainy media can be transported along the stator. For example, eccentric screw pumps are suitable for delivering water, crude oils and a multiplicity of other liquids.

For the formation of the delivery spaces and in order to be able to deliver the given medium with the smallest possible backflow, the rotor lies against an inner wall of the stator formed by elastic material, pressure being applied. Such an eccentric screw pump is known for example from DE 10 2010 037 440 A1.

Such eccentric screw pumps known from the prior art can be installed for example in boreholes in order to deliver the given liquid or partially liquid medium out of the borehole.

When such eccentric screw pumps are installed in a borehole, the pumps have to be held fixedly in the borehole on account of the axial and radial forces arising from the given pumping process. For this purpose, possible options for the fixed connection of the given eccentric screw pump to the borehole or for the fixed connection of the given eccentric screw pump to a well pipe arranged in the borehole are known from the prior art. The possible options for the connection comprise radial and axial anchoring for the given eccentric screw pump.

If a replacement of the given pump is to take place or if the given eccentric screw pump is to be removed from the borehole for the purpose of maintenance or suchlike, a costly uninstalling process is required for this in the case of the embodiments known from the prior art, the anchorages having to be released. Systems would be desirable wherein eccentric screw pumps could be removed from a borehole in a simplified way.

SUMMARY

The problem of the invention, therefore, is to make available a pump system and a method, wherein simple and time-optimised removal of the given eccentric screw pump from a borehole can take place.

The above problem is solved by a pump system for delivering viscous or partially viscous media from a borehole and by a method for removing an eccentric screw pump out of a well pipe installed in a borehole according to the present invention.

The invention relates to a pump system for delivering viscous or partially viscous media from a borehole. Such pump systems, such as are provided for the present invention, can be suitable for example for delivering water, crude oils and a multiplicity of other liquids. If need be, a liquid medium can be delivered from the borehole together with a content of solids.

According to the invention, a riser or a well pipe is installed fixed in the borehole. If an eccentric screw pump, as will be described in greater detail below, is removed from the borehole, the latter is moved relative to the riser or relative to the well pipe. When it is removed from the borehole, the eccentric screw pump can thus be guided through a riser or passed through a riser.

The pump system also comprises a motor, which is coupled to an eccentric screw pump. The motor can expediently be installed in the borehole and beneath the eccentric screw pump. In preferred embodiments, the motor is constituted as an asynchronous motor. With such embodiments, it is possible in an advantageous way to drive the given eccentric screw pump with a rotary frequency of less than 700 revolutions per minute. In preferred embodiments, therefore, the motor is constituted as an electric motor. In particular, the motor can be brought into an operative connection with a pressure compensator.

When the eccentric screw pump, as will be described in greater detail below, is removed from the borehole, the motor can remain in the borehole. The connection between the eccentric screw pump and the motor or the connection between the eccentric screw pump and a drive shaft and/or a drive hub of the motor can thus be constituted detachable. In particular, the connection between the eccentric screw pump and the motor can be constituted detachable by an axial movement of the eccentric screw pump.

The connection between the eccentric screw pump and a drive shaft and/or a hub of the motor can also be constituted such that the connection continuously permits an axial movement of the eccentric screw pump in the direction of a borehole opening or that the axial freedom of movement of the eccentric screw pump orientated in the direction of the borehole opening is not impaired by its connection to the motor. At least in the axial direction, the given eccentric screw pump is optionally not fixed due to its connection to the motor.

The eccentric screw pump comprises one or more stators and one or more rotors accommodated rotating eccentrically in the stator or stators. The stators each comprise a lining, which is brought into contact with the one or more rotors. If the one or more rotors are moved rotating eccentrically, delivery spaces are formed between the one or more rotors and the lining, said delivery spaces moving along the eccentric screw pump and moving the given medium via the eccentric screw pump or more precisely by means of the moving delivery spaces.

If a plurality of stators is present, the latter are expediently orientated so as to be aligned with one another. For the addressed person skilled in the art, it is clear that, depending on the desired extension of the eccentric screw pump or the given depth of the borehole, he can provide an arbitrary number of stators, which are brought into connection with one another, if appropriate in a fixed and sealed manner.

In order to position the eccentric screw pump fixedly in the borehole or fixedly in the riser, one or more connecting means are provided, by means of which the eccentric screw pump is fixed in the riser in a friction-locked and/or form-fit manner. In particular, such connecting means are constituted so as to absorb radial forces, which result from an eccentric motion of the one or more rotors.

According to the invention, provision is made such that the eccentric screw pump is held by the one or more connecting means with axial freedom of movement for the purpose of its removal from the borehole. The one or more connecting means thus permit an axial movement at the eccentric screw pump in the direction of a borehole opening.

The eccentric screw pump is not fixed in the axial direction by the one or more connecting means. By means of a lifting motion or a pulling motion orientated in the direction of the borehole opening exerted on the eccentric screw pump, the eccentric screw pump can thus be removed, as the case may be, from the borehole or from the riser. Since no axial fixing of the eccentric screw pump is provided by the one or more connecting means, a replacement of the given eccentric screw pump can take place in a straightforward and uncomplicated manner and in a time-optimised manner.

A movement of the eccentric screw pump in the opposite axial direction or in the radial direction can expediently be prevented by one or more connecting means when the eccentric screw pump is fixed in the well pipe. To constitute the one or more connecting means, locating fixtures are particularly suitable into which the eccentric screw pump is inserted in a form-fit manner and/or with which the eccentric screw pump is connected in a form-fit manner. The one or more connecting means can be arranged at least partially and/or at least in sections between the well pipe and the eccentric screw pump.

Embodiments have been tried and tested in practice wherein the connecting means comprise at least one housing installed in the borehole with openings or with suction openings for the medium, wherein a fluidic connection is constituted between the housing and the eccentric screw pump. The one or more connecting means just described can be arranged partially and/or at least in sections between the housing and the eccentric screw pump. The housing can be constituted by a plurality of parts each extending along the well pipe.

For example, a stator of the eccentric screw pump can be accommodated in a form-fit manner by the housing, wherein a fluidically sealed connection is constituted between the eccentric screw pump or between the stator of the eccentric screw pump and the housing. The housing can extend at least in sections along the borehole and, as the case may be, can be arranged between the eccentric screw pump and the well pipe.

In preferred embodiments, a plurality of openings can be provided in the housing radially and one above the other, in order to be able to ensure an adequate feed of the given medium to be delivered by the eccentric screw pump.

The one or more sealing elements can be interposed between the stator and the housing for this purpose. The one or more sealing elements can be constituted as a component of the eccentric screw pump and, when the eccentric screw pump is removed, can be conveyed together with the eccentric screw pump out of the borehole. If wear on one or more sealing elements is observed, the replacement of the one or more sealing elements can take place by removal of the eccentric screw pump in the case of such preferred embodiments.

In particular, embodiments have been tried and tested wherein the given stator comprises a groove, in which the one or more sealing elements are accommodated. The one or more sealing elements preferably extend completely around the outer circumference of the stator, in order to be able to ensure a sealing connection between the stator and the housing.

The given medium, which enters into the housing via the openings, is thus preferably conveyed completely via the eccentric screw pump accommodated in a form-fit manner by the housing.

The housing can be installed fixedly in the borehole, so that a joint removal of the housing expediently does not take place when the eccentric screw pump is removed from the borehole. In particular, it may be the case that, as described in detail below, the housing is connected in a fixed manner to the motor.

It may also be the case that the housing is connected to an anti-rotation device, which prevents a rotating motion of the one or more stators. Since the one or more rotors lie during their eccentric motion against a lining of the one or more stators, a moment is transmitted to the one or more stators by the one or more rotors. The moment can be absorbed by the anti-rotation device and optionally transmitted via the housing to the motor, so that the one or more stators are held fixed inside the housing or accommodating housing mounted at the lower end of the riser during operation of the eccentric screw pump. A rotation of the stators is thus prevented by the anti-rotation device.

It is also conceivable for the housing to comprise at the bottom one or more openings for discharging solid components of the medium to be delivered. As a result of sedimentation, solid components with a large mass are not transported via the eccentric screw pump, but rather may be deposited in the housing, as a result of which an accumulation in the housing takes place during a lengthy operation of the eccentric screw pump. As a result, openings or suction openings in the housing may become closed, and this may possibly be accompanied by an impairment of the pumping process. Such problems can be prevented with the described embodiment, wherein the solid components in question are discharged from the housing via openings at the bottom.

In various embodiments, it is conceivable that a volume flow of liquid medium is conveyed from the eccentric screw pump into the housing, for example before removal of the eccentric screw pump from the borehole, as a result of which solid contents present in the housing pass through the openings and are conveyed out of the housing. The rotor of the eccentric screw pump can be stopped for this purpose. After the rotor is stopped, a return flow of liquid medium into the housing can be observed, which can advantageously be used to flush the solids in question via the openings out of the housing.

Entry of the given medium into the housing can also take place via the openings at the bottom. The openings at the bottom are preferably constituted as bores, which form an acute angle with a longitudinal axis of the well pipe. The openings at the bottom or the bores can thus be orientated inclined in the direction of a borehole base.

As mentioned above, it is conceivable for the housing to be connected non-rotatably to the motor. For this purpose, the housing can for example be connected to the motor in a non-rotational manner by means of the previously described anti-rotation device. A moment can be transmitted from the stator in question to the motor. The motor is preferably installed fixed in the borehole. It has been shown in practice that the motor can absorb a moment of the stator without problem, without thereby becoming de-orientated and/or damaged.

In preferred embodiments, provision is also made such that the housing is installed in the borehole eccentrically with respect to a longitudinal axis of the well pipe and one or more distance elements are provided, which constitute a groove for accommodating an electrical line connection coupled to the motor. The groove can extend at least in sections parallel to the longitudinal axis of the well pipe. As a result of the eccentric arrangement, a free space enlarged in cross-section is created for the electrical line connection, in which free space the electrical line connection can be laid. For example, the one or more distance elements can be arranged in sections along the borehole and can be constituted as a component of the housing, or project from the housing in the direction of the well pipe.

By means of the one or more distance elements, the eccentric screw pump can be held spaced apart from the electrical line connection. Furthermore, the electrical line connection can be passed between the distance elements along the well pipe. Since the eccentric screw pump is subjected to oscillations during its operation and on account of an eccentric motion of the one or more rotors, such distance elements are advisable in order to eliminate with certainty damage to the electrical line connection.

The electrical line connection, or the shaft in which the electrical line connection is laid, can extend along the longitudinal direction of the borehole and between the housing and the well pipe.

Since, as already mentioned above, the motor and the housing can be installed fixed in the borehole, uninstalling of the electrical line connection is not necessary when the eccentric screw pump is removed from the borehole. Furthermore, it can be ensured by means of the distance elements that no damage occurs to the electrical line connection when the eccentric screw pump is removed from the borehole or when an eccentric screw pump is inserted into the borehole. The distance elements preferably remain in the borehole when the eccentric screw pump is removed and are not removed together with the eccentric screw pump from the borehole.

Furthermore, it may be the case that the one or more rotors comprise a toothing system at their free end pointing in the direction of the motor and/or are brought into connection non-rotatably with a toothing system which engages in a form-fit manner in a counter-toothing system driven in a rotary manner by the motor. In particular, embodiments have been tried and tested wherein the one or more rotors are coupled non-rotatably to a preferably flexible shaft, which comprises a toothing system at its free end pointing in the direction of the motor. The toothing system can for example be constituted as an inner or outer toothing system. It is conceivable for the toothing system to be constituted as a serration. The toothing system or the serration can engage in a corresponding counter-toothing system of a hub of the motor.

It may also be the case that the one or more rotors or the flexible shaft at its free end pointing in the direction of the motor comprises an inner toothing system, into which a drive shaft of the motor with a corresponding outer toothing system engages. For the addressed person skilled in the art, it is clear that he can provide other possible options for the driving connection between the motor and the one or more rotors, wherein the eccentric screw pump is optionally not fixed in the axial direction with respect to the motor.

The described embodiment of a connection between the motor and the one or more rotors by means of a suitable toothing system with a corresponding counter-toothing system offers the advantage that the eccentric screw pump can be coupled with the motor by insertion into the borehole and a possible axial freedom of movement of the eccentric screw pump in the borehole continues to be retained even with the constituted connection or coupling between the motor and the eccentric screw pump. The eccentric screw pump can thus be removed from the borehole simply by lifting, without a connection between the motor and the eccentric screw pump having to be released temporarily. When the eccentric screw pump is inserted into the given borehole, the connection between the motor and the eccentric screw pump can be produced easily and in a time-optimised manner.

It is also conceivable for the connecting means to comprise one or more elastic centring elements, which are arranged along the longitudinal axis of the borehole and which at least approximately fix a position of the eccentric screw pump in the well pipe or in the housing. The centring elements can be brought into surface contact with the eccentric screw pump or with one or more of the stators and, if appropriate, can constitute an accommodation for the eccentric screw pump that is circular in cross-section. When the eccentric screw pump is removed, the centring elements can remain in the well pipe or in the housing and are not removed together with the eccentric screw pump from the borehole.

In particular, embodiments have been tried and tested wherein the centring elements are each accommodated by the previously described housing. Here, provision can be made such that the one or more stators of the eccentric screw pump are connected to spacers, which extend away from the given stator in the direction of the centring elements and space the eccentric screw pump apart from the respective centring elements. The spacers can be connected fixedly to the eccentric screw pump, so that a removal of the eccentric screw pump out of the borehole is accompanied by a removal of the spacers. In various embodiments, at least two such spacers, but preferably three or more spacers, are connected to the one or more stators. The spacers can optionally project radially from the respective stator or stators.

Since the eccentric motion of the one or more rotors is accompanied by oscillations of the eccentric screw pump, embodiments with such elastic centring elements have been tried and tested in order to prevent larger oscillation amplitudes of the eccentric screw pump, or to counteract larger oscillation amplitudes of the eccentric screw pump.

As already mentioned above, distance elements can be constituted as a component of the housing and/or can project from the housing in the direction of the well pipe. It is conceivable for the distance elements to extend radially away from the housing and in the direction of the well pipe. The distance elements can be brought into surface contact with the well pipe.

As will be described in greater detail below in respect of the method according to the invention, the eccentric screw pump is removed from the borehole by a pulling motion orientated in the direction of the borehole opening. The embodiment with a plurality of centring elements also offers the advantage that, by means of the centring elements, forced guidance can be provided for the eccentric screw pump in the event of axial movement, so that the eccentric screw pump can be introduced into the borehole in a defined manner by means of the forced guidance and can be removed from the borehole in a controlled manner.

During a pumping process of the eccentric screw pump, axial forces corresponding to the given eccentric screw pump act in the case of eccentric screw pumps known from the prior art, said axial forces being accompanied by a conveying motion of the given medium. Since the eccentric screw pump according to the invention is held by the one or more connecting means with an axial degree of freedom for the purpose of its removal from the borehole, embodiments have in particular been tried and tested wherein the axial forces do not occur or are at least for the most part kept small, in order to prevent an unintentional de-orientation of the eccentric screw pump in the axial direction.

For this purpose, it may be the case that the eccentric screw pump comprises at least one first rotor, which is constituted for the delivery of the given medium in the direction of a borehole opening. In addition, the eccentric screw pump can comprise at least one second rotor, which is connected non-rotatably to the at least one first rotor and is constituted for the delivery of the given medium in the direction of a borehole base.

The at least one first rotor and the at least one second rotor can meet in a pressure region, which is connected fluidically to a channel system for conveying the medium out of the borehole. The medium can thus be conveyed completely from the pressure region via the channel system out of the borehole. For this purpose, the channel system can comprise one or more bypass lines, which extend optionally through the housing and in the direction of the borehole opening. Since an overpressure is created in the pressure region on account of its connection to the rotors, the medium is conveyed out of the pressure region and via the channel system or the one or more bypass lines out of the borehole.

It may be the case that the at least one first rotor and the at least one second rotor are constituted in one piece. In further embodiments, the at least one first rotor and the at least one second rotor can be coupled together non-rotatably by suitable connecting means, such as linkages, bolt connections or suchlike.

Since the at least one rotor brings about a delivery of the given medium in the direction of a borehole opening, first axial forces act on the first rotor which are orientated in the direction of a borehole base. Since the at least one second rotor brings about a delivery of the given medium in the direction of a borehole base, second axial forces act on the at least one second rotor which are orientated in the direction of a borehole opening opposite to the first axial force. In practice, embodiments have in particular been tried and tested wherein the axial forces at least approximately cancel each other out, so that the eccentric screw pump in the borehole does not experience, even in the presence of axial freedom of movement, any de-orientation or any undesired movement in the axial direction.

In order to be able to eliminate with certainty an axial movement during the operation of the eccentric screw pump, it may be the case that the pump system comprises a stop for the eccentric screw pump, which is arranged above the eccentric screw pump and, if appropriate, in the region of a borehole opening. The stop can be constituted as a component of a stator suction port.

Furthermore, it may be the case that the at least one second rotor for the delivery of the given medium is brought into connection with at least one individually assigned suction channel, which extends along the riser in the direction of the borehole base. The suction channel can be fluidically decoupled from the at least one first rotor. By means of the individually assigned suction channel, the medium can be sucked via the least one second rotor first in the direction of a borehole opening, after which it can enter into the eccentric screw pump and then be conveyed onward by the at least one second rotor in the direction of a borehole base.

Furthermore, it is conceivable for the at least one independently assigned suction channel to be constituted as an annular channel run at least in sections around the eccentric screw pump.

Furthermore, the invention relates to a method for removing an eccentric screw pump out of a well pipe installed in a borehole. In the first place, it should be mentioned that features which have previously been described in respect of various embodiments of the pump system according to the invention can also be provided in various embodiments of the method according to the invention. Various features, which are described below in respect of embodiments of the method according to the invention, can also be present in various embodiments of the pump system described above.

The eccentric screw pump for a method according to the invention is fixed in a riser or in a housing by means of one or more connecting means and comprises one or more stators and one or more rotors accommodated rotating eccentrically in the stator or stators. The one or more connecting means continuously permit an axial movement of the eccentric screw pump in the direction of a borehole opening. The eccentric screw pump is therefore not fixed axially by the connecting means in the direction of a borehole opening.

In the method according to the invention, the eccentric screw pump is raised out of the borehole by a pulling motion orientated in the direction of the borehole opening. Since the one or more connecting means, which are provided for fixing the eccentric screw pump, permit its movement in the axial direction, the eccentric screw pump can be removed in a simple and uncomplicated manner from the borehole by means of the pulling motion orientated in the direction of the borehole opening.

Within the scope of the method according to the invention, provision can also be made in preferred embodiments such that the eccentric screw pump is coupled to a winch, which winch produces the pulling motion for lifting the eccentric screw pump out of the borehole. The winch can be brought into operative connection preferably with a drive motor for performing the pulling motion.

For example, the eccentric screw pump can be lifted by means of the winch via cable and/or chain connections. In particular, the eccentric screw pump can comprise at its end pointing in the direction of the borehole opening one or more fixing means for the cable and/or chain connection. For example, a threaded connection can be provided at the upper end of the eccentric screw pump, onto which threaded connection the given fixing means are screwed.

Furthermore, it is conceivable that, after removal of the eccentric screw pump, an eccentric screw pump is inserted into the well pipe and, as a result, its free end pointing in the direction of a borehole base is accommodated in a form-fit manner by a connecting means constituted as a housing.

The eccentric screw pump to be inserted can be another eccentric screw pump. It may also be the case that the eccentric screw pump arranged in the well pipe is removed from the borehole for the purpose of maintenance and/or repair and, following suitable maintenance and/or repair, is inserted again into the borehole or into the riser.

As already mentioned above, one or more centring elements can be arranged along the longitudinal direction of the borehole. By means of the one or more centring elements, a forced guidance can take place during the insertion of the eccentric screw pump into the well pipe for the form-fit accommodation of its free end by the connecting means constituted as a housing.

A forced guidance for the coupling of the one or more rotors to the motor can also take place by means of the one or more centring elements during the insertion of the eccentric screw pump into the well pipe.

BRIEF DESCRIPTION OF THE DRAWINGS

Examples of embodiment of the invention and its advantages are explained below in greater detail with the aid of the appended figures. The size ratios of the individual elements with respect to one another in the figures do not always correspond to the actual size ratios, since some forms are represented simplified and other forms are represented enlarged in relation to the other elements for the sake of better illustration.

DETAILED DESCRIPTION

Identical reference numbers are used for identical or identically acting elements of the invention. Furthermore, for the sake of a clearer view, only reference numbers are represented in the individual figures that are required for the description of the respective figure. The represented embodiments only represent examples as to how the pump system according to the invention or the method according to the invention can be constituted and do not represent a conclusive limitation.

Figure 1:
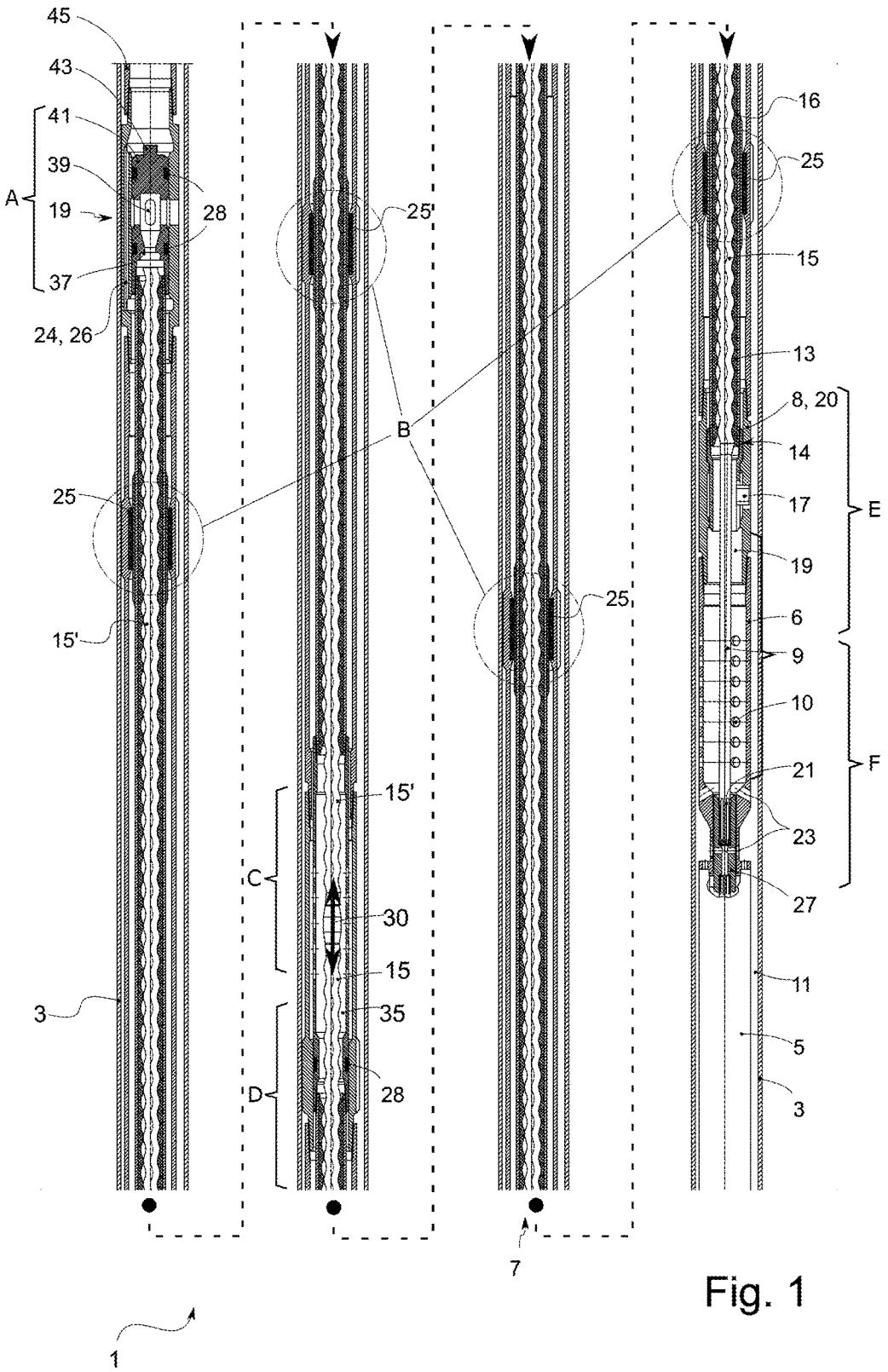
FIG. 1 shows a diagrammatic longitudinal section through an embodiment of a pump system according to the invention.

FIG. 1 shows a diagrammatic longitudinal section through an embodiment of a pump system 1 according to the invention. Pump system 1 is constituted for the delivery of liquids and/or fluid delivery media and/or grainy delivery material and, for this purpose, is inserted into a well pipe 3 of a borehole, which borehole is not represented in FIG. 1.

A well pipe 3 can be seen, which is installed fixedly in the given borehole and is constituted as a hollow cylinder. A motor 5 is provided at the bottom side of the borehole, said motor being constituted as a submersible motor or an electric motor and being brought into an operative connection with a pressure compensator.

Motor 5 comprises a receiving hub 27, which is driven in a rotary manner by motor 5 or more precisely by a shaft 59 (see FIG. 7) of motor 5 and comprises an inner toothing system, into which a flexible shaft 9 engages. Flexible shaft 9 comprises a serration 21 at its free end pointing in the direction of hub 27, said serration engaging in the inner toothing system of hub 27, so that flexible shaft 9 is driven in a rotary manner by hub 27 or in a rotary manner by motor 5.

The present connection between serration 21 and the inner toothing system of hub 27 permits relative movement of flexible shaft 9 with respect to hub 27 along the longitudinal direction of flexible shaft 9, so that flexible shaft 9 can be withdrawn from hub 27 in the axial direction.

If a flexible shaft 9 with serration 21 is to be coupled with motor 5, shaft 9 with its serration 21 merely has to be inserted axially into hub 27 for this purpose.

Flexible shaft 9 is connected non-rotatably to a rotor 15 of an eccentric screw pump 7 and drives rotor 15 eccentrically in a rotating manner. It is conceivable here that rotor 15 is constituted in one piece with flexible shaft 9. In further embodiments, rotor 15 can also be fixed to flexible shaft 9 non-rotatably by means of suitable connecting means.

Rotor 15 is brought during eccentric rotary motion into surface contact with a lining 16 of a stator 13, wherein, as a result of the eccentric motion of rotor 15, a plurality of delivery spaces formed between rotor 15 and lining 16 move along eccentric screw pump 7 for the movement of the liquid medium.

In order to position eccentric screw pump 7 in a stable manner in the borehole, connecting means 20 and 25 are provided, wherein connecting means 20 is constituted as housing 8. In its upper region, housing 8 is coupled with riser 45. In the region of its end 14 pointing in the direction of a borehole base, stator 13 is accommodated in a form-fit manner by connecting means 20 or by housing 8. The form-fit connection is constituted such that connecting means 20 or housing 8 absorb radial movements or radial forces of stator 13, but on the other hand stator 13 has an axial freedom of movement with respect to connecting means 20 or housing 8 in the direction of a borehole opening. An axial anchoring or positioning of eccentric screw pump 7 in the direction of a borehole base is however provided by housing 8.

By means of connecting means 20 or by means of housing 8, eccentric screw pump 7 is therefore not axially fixed in the direction of a borehole opening, so that eccentric screw pump 7 can be moved relative to well pipe 3 and removed from the borehole by a pulling motion orientated in the direction of the borehole opening. As a result of the constituted radial positioning and axial positioning of eccentric screw pump 7 in the direction of the borehole base, eccentric screw pump 7 is held essentially immobile by housing 8 during operation.

An anti-rotation device 17 is also brought into connection with eccentric screw pump 7, said anti-rotation device preventing a rotating motion of stator 13. Anti-rotation device 17 is a component of connecting means 20 or housing 8, so that radial forces of eccentric screw pump 7 are transmitted by anti-rotation device 17 to connecting means 20 or housing 8. Furthermore, a fixed connection is provided between connecting means 20 or between housing 8 and motor 5, so that the radial forces of eccentric screw pump 7 are transmitted by connecting means 20 or housing 8 to motor 5.

Motor 5 is installed fixedly in the borehole. It has been shown in practice that the pressure compensator connected upstream of motor 5 can absorb small radial forces of eccentric screw pump 7 without problem, without becoming de-orientated and/or damaged.

Since flexible shaft 9 is connected fixedly to rotor 15 and is not fixed axially by hub 27, flexible shaft 9 is conveyed together with eccentric screw pump 7 when eccentric screw pump 7 is lifted out of the borehole.

Housing 8 comprises in lower region 6 a plurality of openings 10, via which the given medium can enter into housing 8. A fluidically sealed connection is created between housing 8 and eccentric screw pump 7 or between housing 8 and end 14 of stator 13, so that the given medium entering through openings 10 into housing 8 is transported through eccentric screw pump 7. The medium thereby passes through a suction region 19. A plurality of such openings 10 are introduced into housing 8 radially along the circumference of housing 8.

A plurality of bores 23 are introduced into housing 8 at the bottom of housing 8 and in lower region 6, via which bores solid contents can exit from housing 8 in the case of sedimentation. Bores 23 are each inclined for this purpose in the direction of a borehole base. Blockage of openings 10 or an accumulation of solid contents in housing 8 can thus be prevented.

As can be seen in FIG. 1, housing 8 is constituted multi-part, wherein lower region 6 constitutes an independent part of housing 8. If a multi-part embodiment of housing 8 is provided, the plurality of parts can be connected to one another optionally by a form-fit connection and/or further fixing means.

Figure 3A:
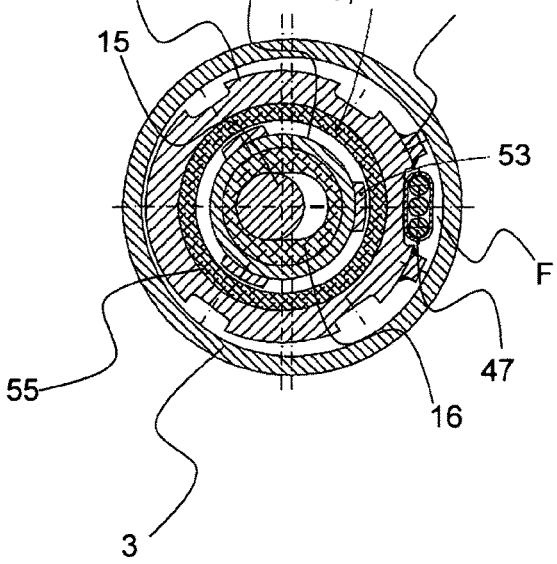
FIG. 3A and FIG. 3B shows a detailed view of a longitudinal section in region B from FIG. 1 and a cross-section through the embodiment of the pump system according to the invention in region B.
Figure 3B:
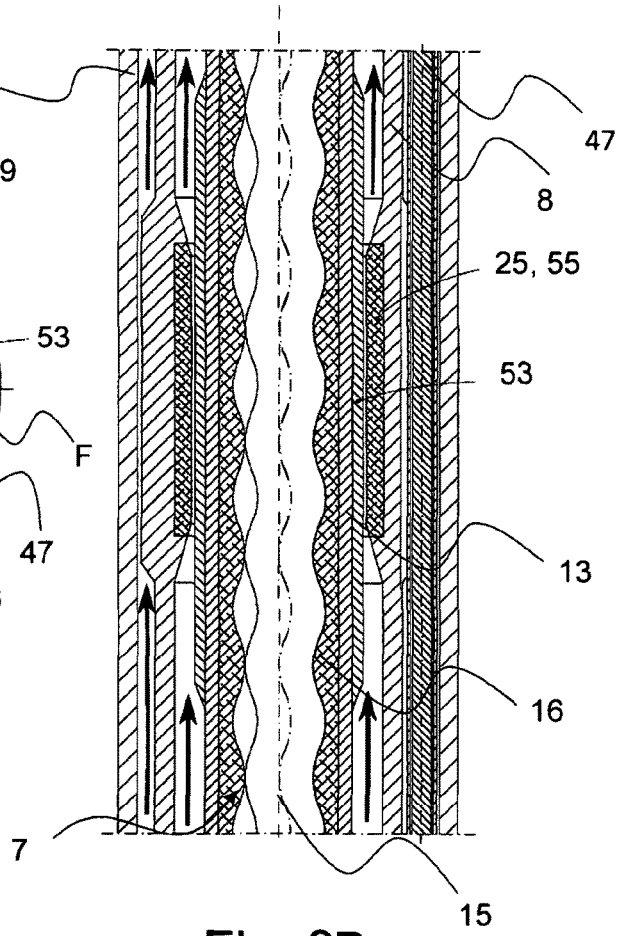

A further fixing means 25 for fixing eccentric screw pump 7 in well pipe 3 is located in regions B, which are represented in detail of FIG. 3. Connecting element 25 is constituted as a centring element 55 and accommodates eccentric screw pump 7 in a form-fit manner. Eccentric screw pump 7 has an axial freedom of movement with respect to connecting element 25 or centring element 55, so that removal of eccentric screw pump 7 from the borehole by a pulling motion orientated in the direction of a borehole opening is not prevented by connecting means 25 or by centring element 55.

In addition, a forced guidance during insertion of eccentric screw pump 7 into the borehole is provided by centring means 55, so that flexible shaft 9 with its serration 21 constituted at the free end meets hub 27 of motor 5 in a target-directed manner. The forced guidance provided by centring means 55 also serves for a controlled and essentially linear removal of eccentric screw pump 7 out of the borehole or out of well pipe 3.

Figure 4:
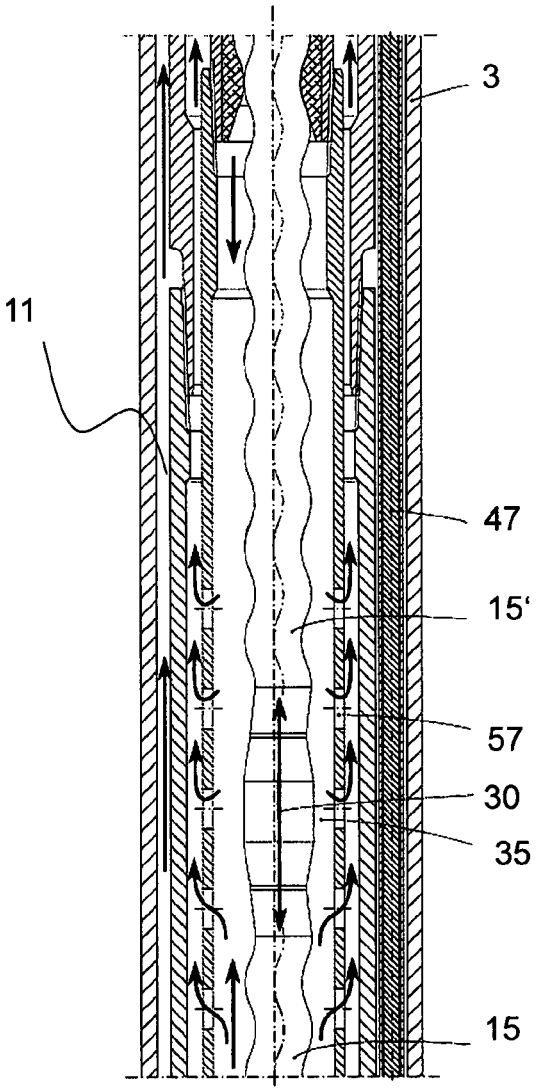
FIG. 4 shows a detailed view of the longitudinal section in region C from FIG. 1.

Pump system 1 comprises a pressure region 35 in region C, which is represented in detail in FIG. 4. The medium is delivered in the direction of a borehole opening by means of rotor 15 of eccentric screw pump 7 and is first fed to pressure region 35. The medium is delivered in the direction of a borehole base by rotor 15' of eccentric screw pump 7 and is also fed to pressure region 35. For this purpose, rotor 15' sucks medium via annular channel 11, which runs between well pipe 3 and housing 8, and then transports the medium in the direction of a borehole base. Rotors 15 and 15' are connected to one another in a non-rotatable manner. On account of their different gradients, the medium is transported through rotors 15 and 15' in opposite directions.

For this reason, the axial forces of rotors 15 and 15' are also orientated in the opposite direction to one another. As indicated by the arrow display, axial forces 30 of rotors 15 and 15' thus completely cancel out. In order to seal pressure region 35, a sealing element 28 (see FIG. 5) is provided beneath region C.

Figure 2A:
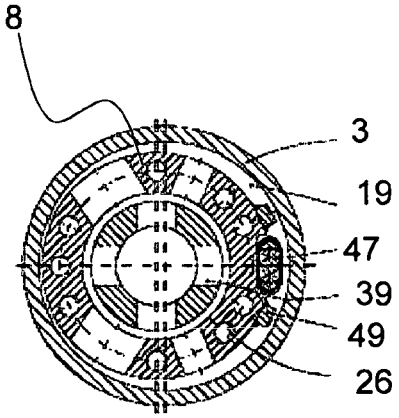
FIG. 2A and FIG. 2B shows a detailed view of the longitudinal section in region A from FIG. 1 and a cross-section through the embodiment of a pump system according to the invention in region A.
Figure 2B:
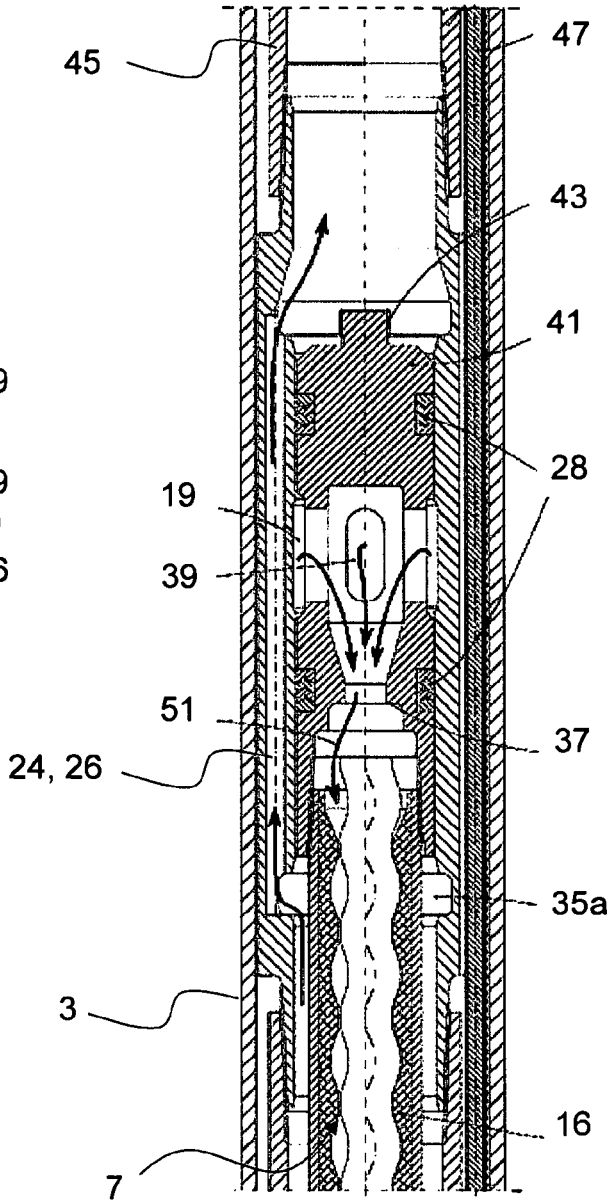

Channel connections 24 or bypass lines 26 can be seen in region A, which is represented in detail in FIG. 2, via which channel connections or bypass lines the medium, proceeding from pressure region 35, is transported out of the borehole. Bypass lines 26 extend through housing 8 in the direction of a borehole opening.

Moreover, stator suction port 41 comprises an axial rotor stop 37, which has a smaller diameter than stator 13 in cross-section. An axial displacement of rotors 15 and 15' of eccentric screw pump 7 is also prevented by means of rotor stop 37.

A threaded stem 43 is also represented, which projects from eccentric screw pump 7 at the upper end of eccentric screw pump 7. Suitable fixing means can be fixed to threaded stem 43, in order to be able to lift eccentric screw pump 7 by means of a winch out of the borehole. Since eccentric screw pump 7 is not axially fixed by connecting means 20 and 25 in the direction of the borehole opening, straightforward removal of eccentric screw pump 7 out of the borehole or out of well pipe 3 or out of riser 45 can take place by lifting using the winch. Eccentric screw pump 7 thereby passes through riser 45.

Riser 45 is connected fluidically to bypass lines 26, so that the medium is conveyed onward by bypass lines 26 to riser 45 during operation of eccentric screw pump 7 and then leaves the borehole.

FIG. 2 shows a detailed view of the longitudinal section in region A from FIG. 1 and a cross-section through the embodiment of an inventive pump system 1 in region A.

Bypass lines 26 can again be seen very clearly in the cross-section represented on the left-hand side, via which bypass lines the medium is transported out of pressure region 35 in the direction of the borehole opening and is carried away out of the borehole by means of riser 45. The medium passes here through a further pressure region 35*a*, such as is represented by way of example in FIG. 2. Bypass lines 26 are constituted in housing 8.

An electrical line connection 47 is also represented, via which motor 5 (see FIG. 1) is supplied with power. The spacing between housing 8 and well pipe 3 is permanently constituted for electrical line connection 47 by means of distance elements 49, so that damage to electrical line connection 47 can be eliminated.

The medium is fed via annular channel 11 (see FIG. 1) to suction region 19, such as can be seen in the left-hand cross-section and in the right-hand longitudinal section of FIG. 2 and then enters into eccentric screw pump 7. The course of the flow from suction region 19 in the direction of eccentric screw pump 7 is again indicated in FIG. 2 by means of an arrow display. The medium is fed by eccentric screw pump 7 in delivery direction 51 or in the direction of the borehole base to pressure region 35 and, proceeding from there, is conveyed onward via already described bypass lines 26 and via riser 45 out of the borehole. Sealing elements 28 are provided to seal pressure region 35 with respect to suction region 19.

Threaded stem 43, which has already been represented in FIG. 1 and projects at the upper end of eccentric screw pump 7, can also be seen in FIG. 2. Suitable fixing means can be fixed to threaded stem 43 in order to lift eccentric screw pump 7 by means of a winch out of the borehole.

FIG. 3 shows a detailed view of the longitudinal section in region B from FIG. 1 and a cross-section through the embodiment of an inventive pump system 1 in region B. Electrical line connection 47, which is run in a shaft formed with the aid of distance elements 49, can again be seen in FIG. 3.

Arranged at the outer circumference of stator 13 is a plurality of spacers 53, which are orientated parallel with the longitudinal extension of well pipe 3 and lie against centring element 55. Spacers 53 are connected to stator 13 and are thus moved together with eccentric screw pump 7 when eccentric screw pump 7 is removed from the borehole. They each extent over a specific distance parallel to the longitudinal axis of well pipe 3, as can be seen in the right-hand longitudinal section in FIG. 3.

A plurality of such elastic centring elements 55 are provided in well pipe 3 or in housing 8, said elastic centring elements together providing a forced guidance for eccentric screw pump 7 during its axial movement. The arrow display also illustrates the volume flow of the medium.

As can be seen in FIG. 3 and also in previous FIG. 2, eccentric screw pump 7, centring elements 55 and housing 8 are offset eccentrically in well pipe 3, so that electrical line connection 47 can be run along well pipe 3 in free space F resulting therefrom.

FIG. 4 shows a detailed view of the longitudinal section in region C from FIG. 1. As can be seen in FIG. 4, the medium is moved by rotor 15' in the direction of a borehole base and fed to pressure region 35. A movement of the medium in the opposite direction takes place by means of rotor 15. Rotor 15 and rotor 15' meet in pressure region 35 and are coupled with one another non-rotatably.

For this reason, axial forces 30 of rotors 15 and 15', which are indicated by means of an arrow display, are also orientated in opposite directions to one another and mutually cancel out.

Although eccentric screw pump 7 has an axial freedom of movement in the direction of a borehole opening, it does not move relative to well pipe 3 or housing 8, since the axial forces, as indicated by means of arrow display 30, completely cancel out with the structural embodiment of a pump system 1 according to the example of embodiment.

Openings 57 are provided in pressure region 35, via which openings the medium flows into bypass lines 26 and is transported onward in the direction of riser 45 (see FIG. 2) or in the direction of the borehole opening.

Rotors 15 and 15' can be produced in one piece, although in further embodiments are connected to one another non-rotatably by means of suitable coupling means in pressure region 35. Furthermore, rotors 15 and 15' have a different gradient, as a result of which the delivery of the medium results in different directions.

Moreover, FIG. 4 again shows electrical line connection 47, which extends between housing 8 and well pipe 3 along pressure region 35 parallel to the longitudinal axis of well pipe 3. Annular channel 11 also runs along pressure region 35 and feeds the medium fluidically separated from the volume flow of bypass lines 26 to suction region 19. The delivery of the medium in annular channel 11 is brought about by means of rotor 15'.

Figure 5:
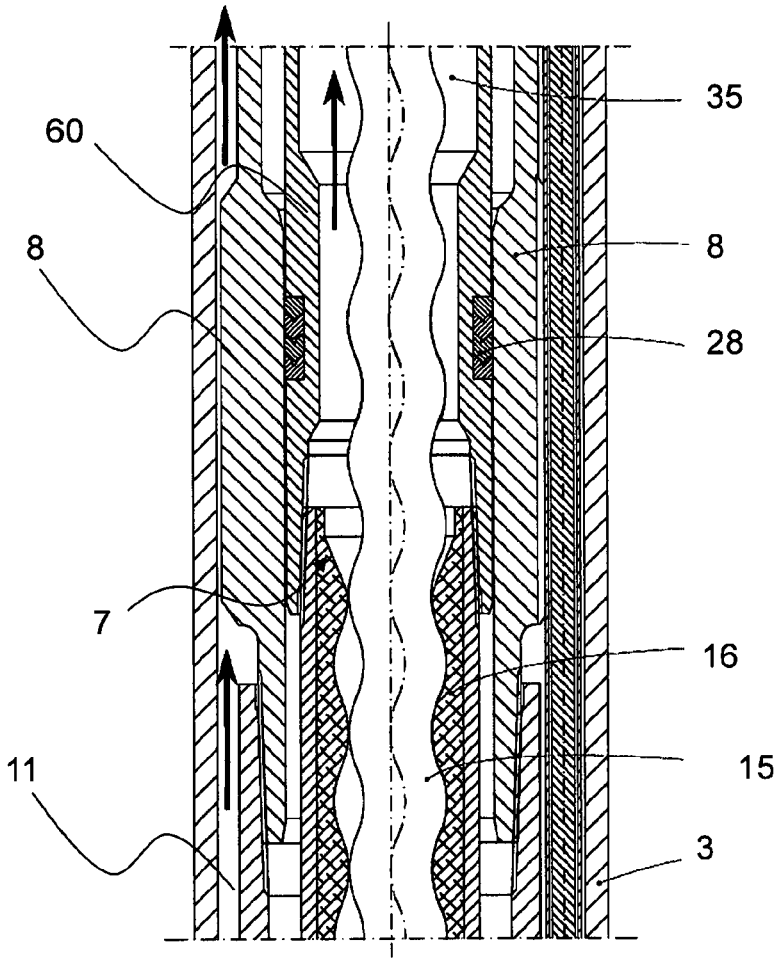
FIG. 5 shows a detailed view of the longitudinal section in region D from FIG. 1.

FIG. 5 shows a detailed view of the longitudinal section in region D from FIG. 1. Sealing element 28 in particular can again been seen in FIG. 5, said sealing element being supported by connecting piece 60 and introduced into a groove of connecting piece 60. Sealing element 28 extends completely around the outer lateral surface of connecting piece 60 and, when eccentric screw pump 7 is removed from riser 45 or from the borehole, is conveyed together with eccentric screw pump 7 out of riser 45 or out of the borehole. If wear can be observed on sealing element 28, a replacement of sealing element 28 can take place by removing eccentric screw pump 7 out of the borehole.

When eccentric screw pump 7, as shown in FIG. 5, is inserted into the borehole or into well pipe 3, sealing element 28 is in surface contact with housing 8. Pressure region 35, as is represented by way of example in FIG. 4, is thus sealed fluidically by means of sealing element 28, so that a passage of medium between housing 8 and connecting piece 60 is prevented by sealing element 28 and its seating against housing 8.

Likewise in region D of pump system 1, as can be seen in FIG. 5, annular channel 11 extends parallel to well pipe 3 along eccentric screw pump 7.

Figure 6:
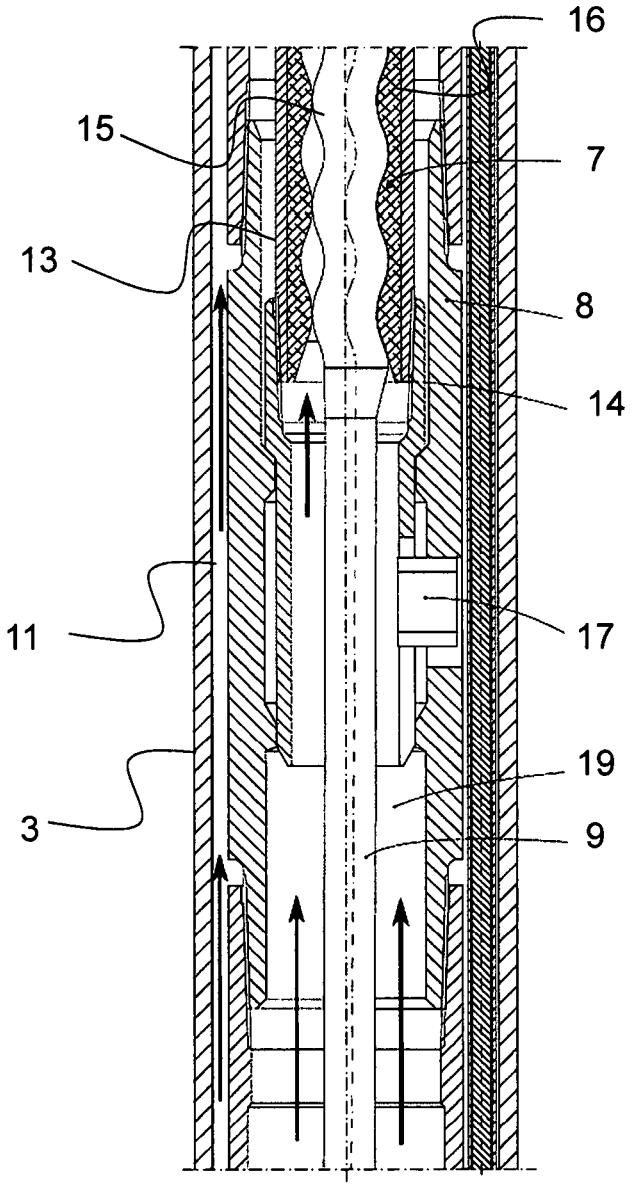
FIG. 6 shows a detailed view of the longitudinal section in region E from FIG. 1.

FIG. 6 shows a detailed view of the longitudinal section in region E of FIG. 1. Eccentric screw pump 7 is accommodated, at an end 14 pointing in the direction of the borehole base or pointing in the direction of motor 5 (see FIGS. 1, 7), in a form-fit manner by housing 8 and is thereby held by housing 8 with the axial freedom of movement and freedom of movement orientated in the direction of a borehole opening.

Radial forces of eccentric screw pump 7 can be absorbed by housing 8 by the form-fit connection shown in FIG. 6 between eccentric screw pump 7 and housing 8 or between stator 13 and housing 8. For this purpose, housing 8 is connected to a motor 5, as is represented in detail in following FIG. 7. Motor 5 absorbs the radial forces transmitted to housing 8.

In order to prevent a relative rotation of the eccentric screw pump 7 with respect to housing 8 or of stator 13 with respect to housing 8, an anti-rotation device 17 is provided. The stator 13 of eccentric screw pump 7 is held by means of anti-rotation device 17. Furthermore, anti-rotation device 17 is fixedly connected to housing 8, so that a moment of stator 13 resulting on account of an eccentric motion of rotor 15 is absorbed by housing 8. As mentioned above, housing 8 is coupled to motor 5 (see FIG. 7). The moment possibly transmitted by stator 13 to housing 8 via anti-rotation device 17 can thus be absorbed by motor 5.

If eccentric screw pump 7 is removed axially out of the borehole or via riser 45 out of well pipe 3, housing 8 and anti-rotation device 17 continue to remain installed in well pipe 3 and, in the presence of an axial movement of eccentric screw pump 7, are not moved together with eccentric screw pump 7.

Figure 7:
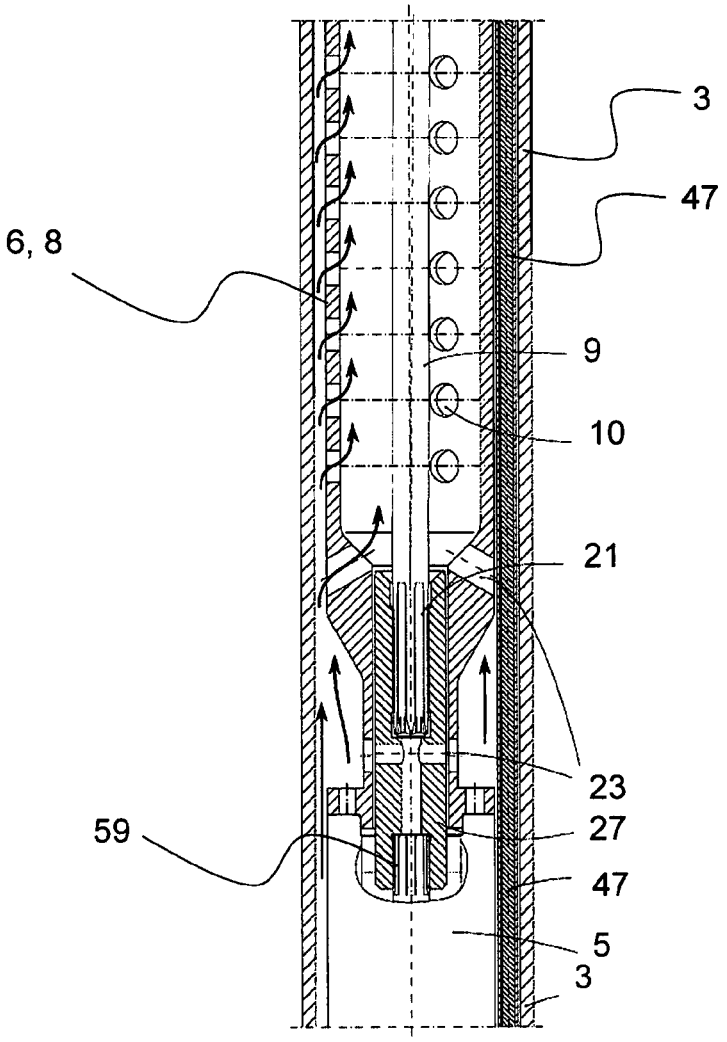
FIG. 7 shows a detailed view of the longitudinal section in region F from FIG. 1.

FIG. 7 shows a detailed view of the longitudinal section in region F from FIG. 1. Motor 5 already represented in FIG. 1 can again be seen in FIG. 7, said motor being constituted as a submersible motor or as an asynchronous motor. Motor 5 is installed by means of riser 45 fixedly in the borehole or in well pipe 3 and is supplied with power via electrical line connection 47.

As can be ascertained from a combined viewing of the preceding figures, electrical line connection 47 extends from motor 5 in well pipe 3 beyond a borehole opening, where line connection 47 is coupled with a supply network. In preferred embodiments, electrical line connection 47 is provided with a sheathing in order to eliminate damage to electrical line connection 47.

In the example of embodiment of FIG. 7, motor 5 drives a hub 27, which comprises an inner toothing system and engages in a form-fit manner with serration 21 of flexible shaft 9. Drive shaft 59 for hub 27 can clearly be seen in FIG. 7. As a result of the form-fit connection between the inner toothing system of hub 27 and serration 21 of flexible shaft 9, a rotary motion of flexible shaft 9 results with a rotary motion of hub 27 via drive motor 5.

Flexible shaft 9 is coupled non-rotatably to rotor 15 of eccentric screw pump 7, so that rotor 15 or more precisely eccentric screw pump 7 can be driven by motor 5 by means of the described form-fit connection.

The described form-fit connection between serration 21 and the inner toothing system of hub 27 is such that flexible shaft 9 and therefore eccentric screw pump 7 connected to flexible shaft 9 has a freedom of movement in the axial direction. Eccentric screw pump 7 can thus be withdrawn together with flexible shaft 9 from motor 5, without the axial freedom of movement of eccentric screw pump 7 in the direction of a borehole opening being hindered by the described form-fit connection.

As previously mentioned, housing 8 is constituted multi-part. The lower part or lower region 6 of housing 8 constituted multi-part can be seen in FIG. 7. Via lower region 6 of housing 8, medium to be delivered passes into the interior of housing 8. For this purpose, a plurality of openings 10 are constituted in housing 8 or more precisely in lower region 6 of housing 8, said openings permitting an inflow of medium into housing 8.

Since end 14 of eccentric screw pump 7 pointing in the direction of the borehole base, as represented in FIG. 6, is accommodated in a form-fit manner by housing 8, the medium entering through openings 10 into housing 8 is transported through eccentric screw pump 7 in the direction of pressure region 35 (see FIG. 4).

Furthermore, bores 23 are constituted in lower region 6 of housing 8, which bores are each inclined in the direction of a borehole base or in the direction of motor 5. Since in practice solid contents enter through openings 10 into housing 8 or into lower region 6 of housing 8, if there is a deposition of the solid contents it can lead to problems during a replacement of eccentric screw pump 7 or during reintroduction of a flexible shaft 9 into hub 27. Advantageously, bores 23 offer the possibility of carrying away solid contents, which are deposited in housing 8 or more precisely in lower region 6 of housing 8, out of housing 8. A risk of a blockage of the toothing system of hub 27 can thus be reduced.

Since eccentric screw pump 7 has a suction effect on the given medium when rotor 15 rotates and eccentric screw pump 7 is accommodated in a form-fit manner by housing 8, medium is also conveyed on account of the suction effect through bores 23 into the interior of housing 8 or into the interior of lower region 6 of housing 8.

Figure 8:
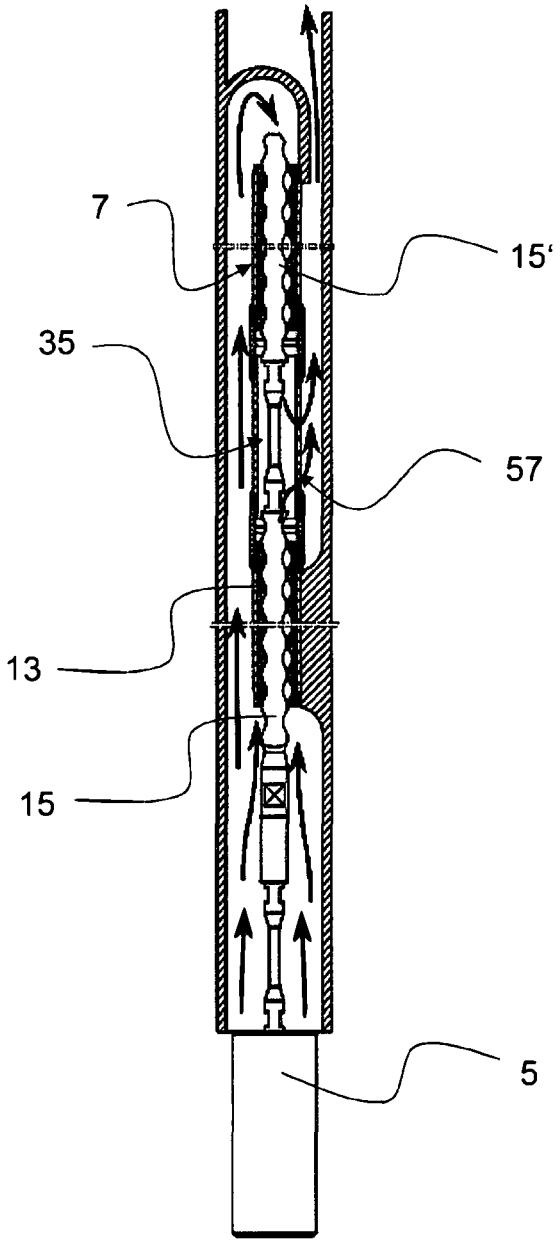
FIG. 8 shows a diagrammatic view of an embodiment of an eccentric screw pump, such as can be provided in various embodiments for the pump system according to the invention and for the implementation of the method according to the invention.

FIG. 8 shows a diagrammatic view of an embodiment of an eccentric screw pump 7, such as can be provided in various embodiments for pump system 1 according to the invention and for implementing the method according to the invention. In particular, FIG. 8 again illustrates the possible course of the flow of the given medium when use is made of an eccentric screw pump 7 according to the structural embodiment of the example of embodiment from FIGS. 1 to 8.

Eccentric screw pump 7 comprises two rotors 15 and 15', which are connected non-rotatably to one another and have different gradients. As a result of the different gradients, the medium is transported by upper rotor 15' in the direction of a borehole base. The medium is transported by lower rotor 15 in the direction of a borehole opening and opposite to the transport direction of upper rotor 15'. Both rotors 15 and 15' are jointly driven by motor 5, which is constituted as an asynchronous motor. For this purpose, rotors 15 and 15' are connected non-rotatably to one another.

Rotors 15 and 15' meet in a pressure region 35 or rotors 15 and 15' convey the medium in each case into a pressure region 35, which can be constituted as a component part of eccentric screw pump 7.

Eccentric screw pump 7 comprises one or more openings 57 (see FIG. 4) in pressure region 35. In the example of embodiment of FIG. 7, eccentric screw pump 7 comprises a lateral opening, which is connected fluidically to a channel guide for discharging the medium from the borehole. Since an overpressure prevails in pressure region 35, the medium is conveyed via the channel guide out of the borehole under the effect of pressure.

On account of the different delivery direction of rotors 15 and 15' for the given medium, the axial forces acting on rotors 15 and 15' are orientated in opposite directions to one another and at least for the most part cancel each other out. For this reason, eccentric screw pump 7 can be mounted without an axial fixing constituted in the direction of a borehole opening.

The medium is drawn along by suction by rotor 15' and first conveyed past the sides of eccentric screw pump 7, before it enters into eccentric screw pump 7.

The invention has been described by reference to a preferred embodiment. A person skilled in the art can however imagine that modifications or changes to the invention can be made without thereby departing from the scope of protection of the following claims.

What is claimed is:

1. A pump system for delivering viscous or partially viscous media from a borehole, comprising:

a well pipe installed in the borehole, a riser, and a motor, which is coupled with an eccentric screw pump, wherein the eccentric screw pump comprises one or more stators and one or more rotors accommodated rotating eccentrically in the stator or stators, as well as one or more connecting means, which fix the eccentric screw pump in the well pipe in a friction-locked and/or form-fit manner, wherein the eccentric screw pump is held with an axial freedom of movement by the one or more connecting means so that the eccentric screw pump is removable from the borehole, wherein the one or more connecting means centers the eccentric screw pump in the well pipe while the eccentric screw pump is inserted or removed from the well pipe.

2. The pump system according to claim 1, wherein the one or more connecting means comprise at least one housing installed in the borehole with suction openings for the medium, wherein a fluidically sealed connection is constituted between the housing and the eccentric screw pump.

3. The pump system according to claim 2, wherein the housing is connected to an anti-rotation device, which prevents a rotating motion of the one or more stators.

4. The pump system according to claim 3, wherein the housing is connected non-rotatably to the motor.

5. The pump system according to claim 3, wherein the housing comprises at the bottom one or more bores for discharging solid components of the medium to be delivered.

6. The pump system according to claim 2, wherein the housing comprises at the bottom one or more bores for discharging solid components of the medium to be delivered.

7. The pump system according to claim 6, wherein the housing is connected non-rotatably to the motor.

8. The pump system according to claim 2, wherein the housing is connected non-rotatably to the motor.

9. The pump system according to claim 2, wherein the housing is installed in the borehole eccentrically with respect to a longitudinal axis of the well pipe and comprises one or more distance elements and/or is connected to one or more distance elements, which constitute a shaft extending along the well pipe for accommodating an electrical line connection coupled to the motor.

10. The pump system according to claim 1, wherein a free end of the one or more rotors comprises a toothing system pointing in the direction of the motor and/or the one or more rotors are brought into connection with a toothing system, which engages in a form-fit manner in a counter-toothing system driven in a rotary manner by the motor, wherein the rotor is attached non-rotatably relative to the motor.

11. The pump system according to claim 10, wherein the one or more rotors are connected non-rotatably to a flexible shaft, which comprises a serration at the free end pointing in the direction of the motor for the form-fit engagement in the counter-toothing system driven in a rotary manner by the motor.

12. The pump system according to claim 1, wherein the one or more connecting means comprise one or more elastic centring elements, which are arranged along the longitudinal direction of the borehole and which at least approximately fix a position of the eccentric screw pump in the well pipe.

13. The pump system according to claim 1, wherein the eccentric screw pump comprises:

at least one first rotor, which is constituted for the delivery of the given medium in the direction of a borehole opening, at least one second rotor, which is connected non-rotatably to the at least one first rotor and is constituted for the delivery of the given medium in the direction of a borehole base, wherein the at least one first rotor and the at least one second rotor meet in a pressure region, which is connected fluidically to a channel system for conveying the medium out of the borehole.

14. The pump system according to claim 13, wherein the at least one second rotor for the delivery of the given medium is brought into connection with at least one individually assigned suction channel, which extends along the well pipe in the direction of the borehole base.

15. The pump system according to claim 14, wherein the at least one individually assigned suction channel is constituted as an annular channel run radially around the eccentric screw pump.

16. A method for removing an eccentric screw pump out of a well pipe installed in a borehole comprising:

gripping the eccentric screw pump, wherein the eccentric screw pump comprises a rotor configured to rotate eccentrically in a stator and is fixable in the well pipe via a connecting means, and lifting the screw pump axially towards a borehole opening wherein the connecting means provides continuous axial movement in a direction of the borehole opening and centers the eccentric screw pump in the well pipe during lifting.

17. The method according to claim 16, wherein the eccentric screw pump passes through a riser when the electric screw pump is lifted out of the borehole opening.

18. The method according to claim 17, wherein the eccentric screw pump is gripped with a winch, wherein the winch produces the pulling motion for lifting the eccentric screw pump out of the borehole opening.

19. The method according to claim 17, wherein, after removal of the eccentric screw pump, a second eccentric screw pump is inserted into the well pipe and, as a result, the electric screw pump's free end pointing in the direction of a borehole base is accommodated in a form-fit manner by the one or more connecting means constituted as a housing.

20. The method according to claim 18, wherein, after removal of the eccentric screw pump, a second eccentric screw pump is inserted into the well pipe and, as a result, a free end of the second eccentric screw pump pointing in the direction of a borehole base is accommodated in a form-fit manner by the one or more connecting means.

21. A pump system for delivering media from a borehole comprising:

a well pipe installed in the borehole, a riser, and a motor configured to couple with an eccentric screw pump, wherein the eccentric screw pump comprises, a stator, a rotor configured to rotate eccentrically in the stator, wherein the eccentric screw pump is encased by a housing, the housing being fluidically sealed via a sealing element to the eccentric screw pump, wherein the eccentric screw pump has an axial freedom of movement with respect to the well pipe, and wherein a connecting means attached to the stator centers the eccentric screw pump in the well pipe while the eccentric screw pump is inserted or removed from the well pipe.

* * * * *